US007749451B2

(12) United States Patent
West

(10) Patent No.: US 7,749,451 B2
(45) Date of Patent: Jul. 6, 2010

(54) UNIVERSAL SECURE CLAMPING APPARATUS

(76) Inventor: Yale West, 416 Apollo Dr., Bethlehem, PA (US) 18017

( * ) Notice: Subject to any disclaimer, the term of this patent is extended or adjusted under 35 U.S.C. 154(b) by 1356 days.

(21) Appl. No.: 11/063,054

(22) Filed: Feb. 22, 2005

(65) Prior Publication Data

US 2005/0186121 A1 Aug. 25, 2005

Related U.S. Application Data

(60) Provisional application No. 60/546,221, filed on Feb. 20, 2004.

(51) Int. Cl.
*B01L 3/00* (2006.01)

(52) U.S. Cl. ..... 422/102; 422/58; 422/99; 422/103; 422/104; 435/288.3; 435/288.5; 220/241

(58) Field of Classification Search ..... 422/102, 422/103, 58, 99, 104; 435/288.3, 288.5; 220/241

See application file for complete search history.

(56) References Cited

U.S. PATENT DOCUMENTS

| | | | | |
|---|---|---|---|---|
| 4,493,815 | A | 1/1985 | Fernwood et al. | |
| 5,741,463 | A | 4/1998 | Sanadi | |
| 6,054,100 | A | 4/2000 | Stanchfield et al. | |
| 6,486,401 | B1 | 11/2002 | Warhurst et al. | |
| 2002/0039545 | A1 * | 4/2002 | Hall et al. | 422/102 |

* cited by examiner

*Primary Examiner*—Lyle A Alexander
*Assistant Examiner*—Dennis M White
(74) *Attorney, Agent, or Firm*—Sanford J. Piltch, Esq.

(57) ABSTRACT

A secure clamping system for sealing and storing multiple vessels such as commercially available vial arrays, multi-well plates, and deep well blocks, as typically used in the chemical, pharmaceutical, or biological fields including top and bottom plates, with or without drainage or injection ports, secured to the array or well by a C-shaped clamping member that may be fixed or adjustable, or by top and bottom clamping plates having opposite side height adjustable bracket members with cooperating locking members, or by top and bottom clamping plates having eccentrically cammed grasping arms, all for retaining the plates in a secure, leak-proof fit over the top and bottom of the array, well or block.

12 Claims, 6 Drawing Sheets

UNIVERSAL SECURE CLAMPING APPARATUS

CROSS-REFERENCE TO RELATED APPLICATION

This application claims the benefit of U.S. provisional patent application accorded Ser. No. 60/546,221, filed Feb. 20, 2004.

BACKGROUND OF THE INVENTION

The present invention generally relates to a secure clamping system for sealing multiple vessels such as vial arrays, multi-well plates, and deep well blocks, as typically used in the chemical, pharmaceutical, or biological arts. This clamping device will be used to secure commercially available storage units having sealing mats with or without dimples (plugs). The dimples, or plugs, are inserted into one or more individual wells or vials providing enhanced isolation of one such well or vial from another. The purpose of securely clamping the sealing mats is to prevent evaporation, spillage or contamination of a liquid contained therein, or the inadvertent transfer of the liquid from one well to another, as well as to provide a mechanical means to secure the flexible sealing mat to multi-vessel arrays in order to prevent the sealing mat from dislodging, and allow for a variety of applications including, but not limited to, reaction chemistry, liquid/liquid extraction, compound and solution storage.

In the chemical, pharmaceutical, and biochemistry arts, multi-compartment vessels are commonly used to carry out chemical reactions and store reagents and samples. Multi-well plates come in a variety of formats, 24 wells—4×6 array; 48 wells—6×8 array; 96 wells—8×12 array, but now a 384 and a 1536 well format are becoming increasingly common. Multi-well plates may be manually handled or handled by automated systems. Materials or samples are placed in the various compartments of the vessel and covered with a flexible sealing mat. Fluids may be transferred between selected wells, and the plates may be manipulated for storing, reacting and/or analyzing the samples. Accordingly, a means is needed to securely cover the vessel to ensure that the materials will not be spilled, and/or that the gases from the reaction do not escape to the atmosphere. A loose-fitting seal does not significantly guard against evaporation, sublimation, absorption, or cross-contamination between wells.

Numerous attempts have been made to provide a secure sealing system, however, they have a number of shortcomings, which the present invention overcomes. For example, one method of sealing the storage containers involves using a commercially available heat-sealable foil or plastic film that may be applied across the entire upper surface of the plate. Application of these films provide an efficient, gas and liquid tight seal, but the heat-sealing process to secure the films in place is cumbersome, may warp the plate and affect its performance in automated robotic equipment. In addition, access to each well can only be obtained by piercing the film or by peeling the film off by hand or with a foil stripper, causing the end user to re-apply the film. Consequently, this type of seal is not re-usable.

In other sealing systems, the clamping systems are made of more than two parts. This increases the difficulty needed to utilize the equipment, leading to potential spillage of the contents. In addition, having many parts increases the chance that parts will get misplaced or confused with other systems. Additionally, in these other systems, the sealing clamps are specific to a particular vessel type and dimension, and cannot be used for vessel types of different dimensions, which can result in a costly expense to the consumer. Lastly, other systems specifically do not allow for vessels that have bottom drain ports, such as filter plates, thereby preventing the vessel to be drained without disassembling the sealing system.

SUMMARY OF THE INVENTION

The present invention overcomes the deficiencies in the prior art by allowing for a universal secure clamping system that can be used on a variety of commercially available vial arrays, multi-well and single-well storage blocks and containers, either with or without dimpled flexible sealing mats. The particular geometry of a well, whether round, rectangular or square in cross-section, is immaterial to this invention.

In accordance with one preferred embodiment of the present invention, there is provided a base plate with or without drainage ports, a top plate with or without fluid injection or removal ports, and a C-clamp style strip made of metal that is sufficiently rigid to keep its shape, yet have enough spring action to allow for easy application and removal. In the event that the multi-well plate has an integral bottom, the reinforcing bottom plate will not be required.

In another preferred embodiment of the invention, there is provided a clamping system comprising: (1) a base plate and a top plate, either with or without drainage or injection ports, (2) an expandable (or contractible) C-clamp style strip having a cooperating set of overlapping clamp arms that are adjustably moved inward and outward to accommodate differently sized well arrays and can be secured in a desired position by a tightening means. An alternative arrangement may be utilized with the adjustment for size being located along one side (or end) of the well array with one gripping and tightening arm being adjustably moveable in relation to one arm of the cooperating clamp arms extending over the top of the well array and tightened to hold the plates in position by a threaded tightening means exerting pressure inward against the opposing clamp arm from the overlapping portion of the first clamp arm.

In accordance with another preferred embodiment of this invention, there is provided a clamping system comprising: (1) a base plate and a top plate, either with or without drainage or injection ports, (2) a cooperating pair of brackets extending perpendicularly upward from and on opposite sides of the rectangular plates, with a channel or slot to receive a plate position securing means. The brackets are secured to each other at the desired spatial relationship depending upon the dimensions of the well using one of several spatial retention means, for example, a hip-squared carriage bolt with a rounded head that will not turn once engaged in the channel. The bracket and the channels can be of varying heights, so as to allow for securely clamping more than one storage container at a time, or containers or wells of varying heights.

In yet another preferred embodiment of the invention, there is provided a clamping system comprising: (1) a base plate and a top plate, (2) a paired set of articulating clamps on either side of the base plate that are engageable with a latching means opposing the clamp arms on either side of the top plate to secure one plate to the other plate retaining the sealing mat and stored articles securely therebetween.

In each of the preferred embodiments, the plates, brackets and springs are made of metal, such as steel, aluminum or other metal alloys, plastic-coated metals having similar properties and physical characteristics, or more rigid plastics.

The present invention has the direct advantages that it is universal and can be used on vessels of various dimensions, greatly reducing the cost to the consumer, as well as it being universal in the fact that the top and bottom plates can be interchanged, thus rendering the clamping system easier to use. In addition, this invention allows for an added convenience and flexibility in the fact that the top and bottom plates can contain a plurality of small injection ports or small drainage ports, respectively, that allow for titration, drainage, or other action without taking the clamping system apart. This is particularly useful, for example, when it is necessary to stack the trays on top of each other in order to allow the top system to drain into the lower system.

BRIEF DESCRIPTION OF THE DRAWINGS

For the purpose of illustrating the invention, there is shown in the drawings embodiments which are presently preferred; it being understood, however, that the invention is not limited to the precise arrangements and instrumentalities shown.

DETAILED DESCRIPTION OF THE PREFERRED EMBODIMENTS

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figure 1:
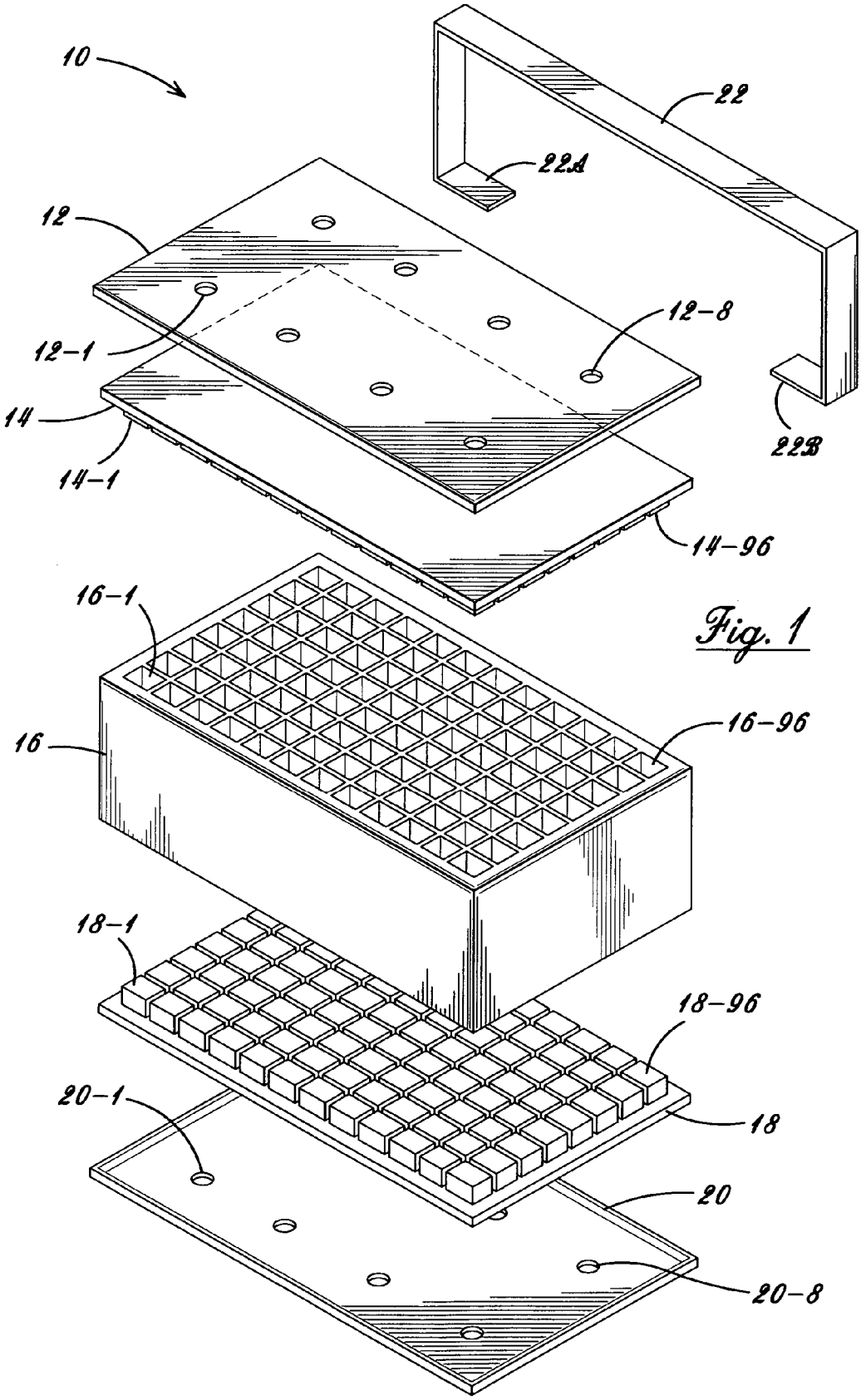
FIG. 1 is an exploded perspective view of one preferred embodiment of the invention, showing base and top plates and a C-style clamping means, including the storage container or well and flexible sealing mat covers.

Referring now to the drawings in detail, where like numerals refer to like parts or elements, there is shown in FIG. 1, according to the first embodiment of this invention, a secure clamping apparatus 10 comprising a rectangular bottom clamp plate 20, with or without a plurality of small drainage holes 20-1 through 20-8. The rectangular plate 20 is sized to accommodate most commercially available multi-well array sizes, such as 96 wells in a 12×8 array. The identically sized bottom sealing mat 18, with raised square plugs (for purposes of cooperating geometry and dimension) numbered 18-1 through 18-96, is placed on top of the rectangular bottom plate 20 with the plugs facing upwards. Then the identically sized multi-well chamber 16 is placed on top of the bottom sealing mat 18, with the corresponding containment wells or chambers, numbered 16-1 through 16-96 engaged accordingly. The containment wells can then be filled with the appropriate materials, such as chemicals, reactants, diluents, or compounds in preparation for storage or reaction, and the like. The identically sized top sealing mat 14 with protruding square plugs, numbered 14-1 through 14-96, is placed on top of the multi-well chamber 16 with the plugs facing downwards, making sure that the sealing mat plugs, numbered 14-1 through 14-96, are securely engaged with the corresponding containment chamber openings, 16-1 through 16-96. The identically sized top clamp plate 12, with or without a plurality of small injection ports 12-1 through 12-8, is placed on top of the sealing mat 14. The number of drainage and injection ports, as shown in FIG. 1, in both the top and bottom plates are merely representative of the total number of such ports that are intended to correspond with each of the wells in the multi-well chamber 16. The top and bottom plates 12, 20 may be customized to accommodate non-standard formats for the vial arrays, wells or containment blocks that retain standardized dimensions common in the industry. These top and bottom plates 12, 20 may also be molded from suitable engineered plastics that do not exhibit fatigue through continued, repeated use or by exposure to certain solvents. The plastics are also to be resistant to heat and retain their rigidity and strength during their use. Further, the mats 14, 18 may have cooperating apertures that permit drainage from or the addition of liquids to the various wells in the multi-well container 16 with the unit assembled and a clamping means in place to retain the various elements together as a unit.

Once the unit is assembled, a releasable C-shaped clamp 22, with extension arms 22A and 22B, is placed around the exterior of the storage unit in order to secure the various parts together as a unit. The C-clamp may be fashioned from a memory shaped material to form a partially closed structure with a width that is less than the width of the storage container yet wide enough to form a strong seal, with a thickness that enables it to deflect outwardly when a force is applied to its respective free ends at arms 22A and 22B. The secure clamping apparatus 10, engaged about the multi-well chamber 16 and sealing mats 14, 18, is ready for storage or other activity as may be required. Alternatively, the C-clamp may be of an entirely rigid material and slip onto the assembled unit from one side to retain the various elements together as a unit.

The combination of the various elements just described can be modified to exclude the bottom clamping plate 20 and the bottom flexible sealing mat 18 in the event that the multi-well plate has its own integral sealed bottom. Another modification is that clamp 22 can be oriented to fit around the bottom of the multi-well plate 16 and engage its grasping arm extensions 22A, 22B partially across the top of top clamping plate 12.

The top and bottom clamping plates 12, 20, and clamping means 22 and grasping arm extensions 22A and 22B, are made of a rigid material, preferably with low thermal expansion and little potential for contaminating the contents of the containment wells 16-1 through 16-96. The top and bottom clamp plates 12, 20, and clamping means 22 may be machined from aluminum or similar alloy, or stainless steel. It is also envisioned that top and bottom plates 12 and 20 could also be molded from an engineered plastic with relatively low thermal expansion, such as a polycarbonate. The C-shaped clamping means 22 and grasping arm extensions 22A and 22B are presently preferred to be of a material that is sufficiently rigid to keep its shape, yet have sufficient spring action to allow for easy application and removal without distortion, warping or breakage.

Figure 2:
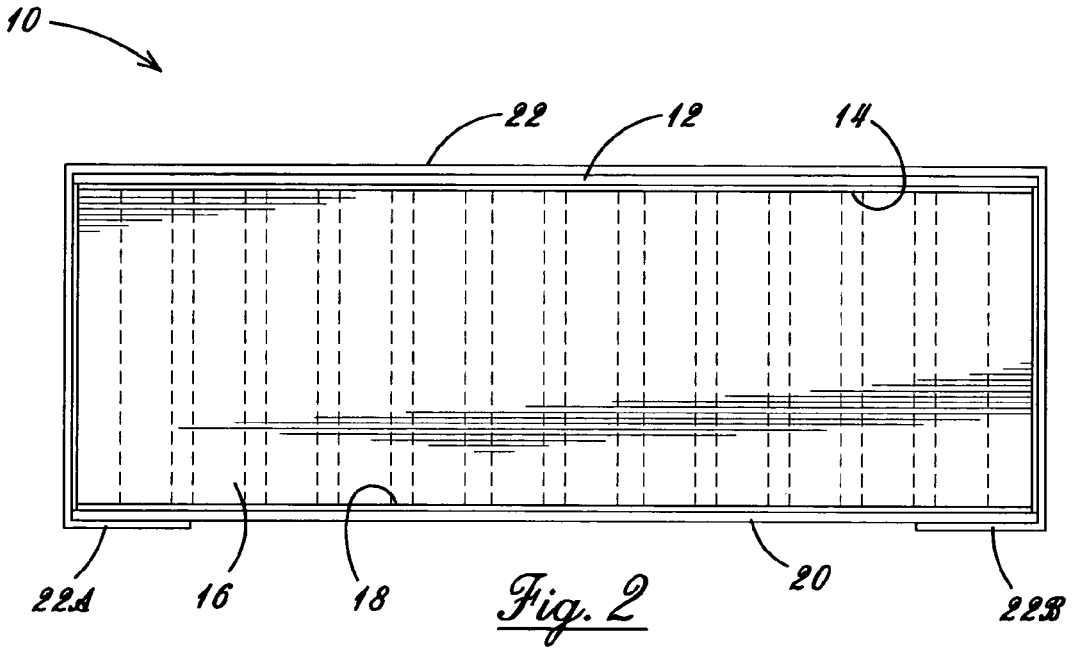
FIG. 2 is a side view of the first preferred embodiment, showing the C-style clamp engaged to hold the sealing mats securely in position about the container or well.

FIG. 2 shows a plan view along one side of the assembled universal secure clamp system 10 comprising the bottom clamp plate 20, the bottom sealing mat 18, the multi-well chamber 16, the top sealing mat 14, the top clamp plate 12, and the C-shaped clamp 22 secured on the outside with grasping arm extension 22A and 22B extending around the bottom clamp plate 20. The secure clamping apparatus 10, engaged about the multi-well chamber 16 and sealing mats 14, 18, will remain in position for storage or until removed for other activities as needed.

Figure 2A:
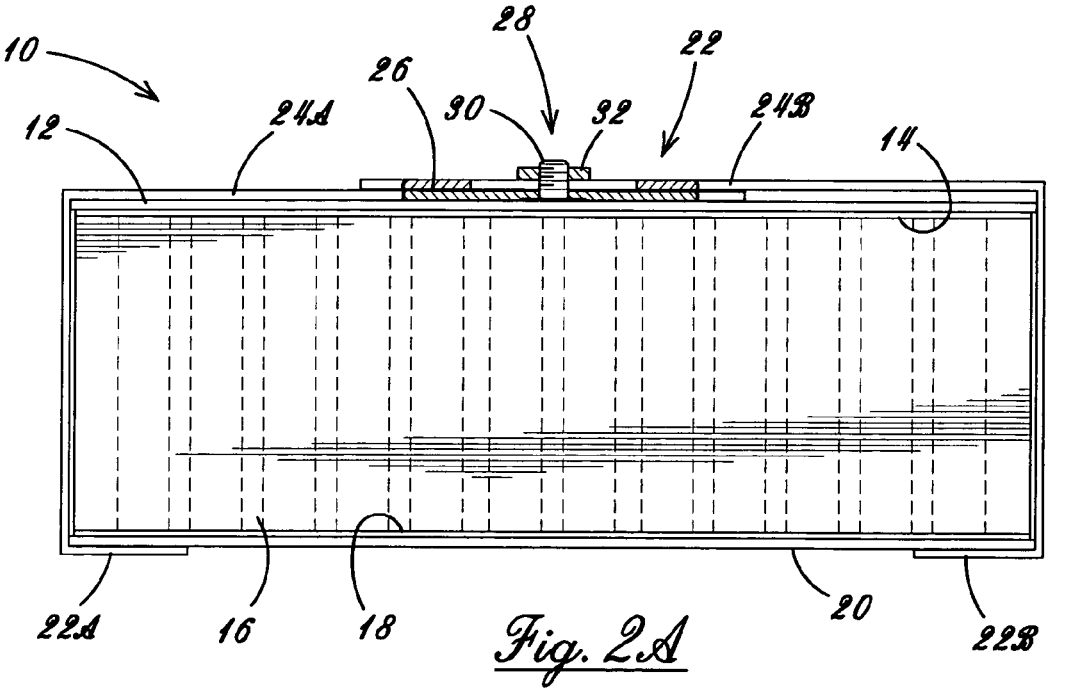
FIG. 2A is a side view of an alternate clamping apparatus for use with the first preferred embodiment of the invention, showing base and top plates and a C-style clamping means having the capacity to expand or contract laterally in an overlapping manner with a top securing means, including the storage container or well and flexible sealing mat covers.
Figure 2B:
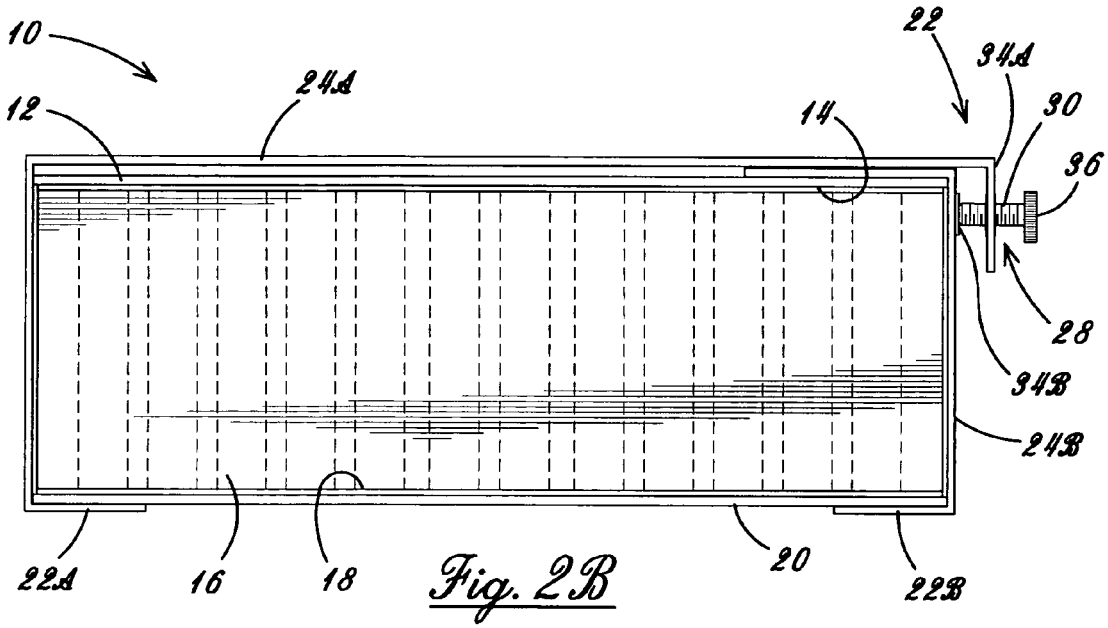
FIG. 2B is a side view of a second alternate clamping apparatus for use with the first preferred embodiment of the invention, showing base and top plates and a C-style clamping means having the capacity to expand or contract laterally in an overlapping manner with a side securing means, including the storage container or well and flexible sealing mat covers.

FIGS. 2A and 2B show two alternate versions of the clamping apparatus 22. In FIG. 2A the clamp 22 is comprised of first and second legs 24A and 24B that overlap one another and are slideable along the overlapping surfaces of the respective legs 24A, 24B. The legs 24A and 24B are retained in the desired longitudinal overlapping position along each of the respective legs by a slot 26 common to both through which slot an adjusting and tightening means 28 extends. The adjustment and tightening means 28 may be comprised of a threaded screw 30 extending upwards away from the top plate 12 and through the common slot 26 of both legs 24A, 24B of the clamp 22 with a flanged nut 32 may be used to loosen or tighten the grip of the adjusting and tightening means 28 on the legs 24A, 24B so that the clamp 22 may be extended to open the multi-chambered well 16, or retracted to clamp the several parts of the unit and retain them together, by bringing the arms 22A, 22B of the clamp 22 inward to grasp the assembled unit or outward to release the parts of the assembled unit. The threaded screw 30 rides within the slot 26 and is retained against the inward side of the leg 24A of the clamp 22 by its flat head. The other leg 24B is able to slidingly engage the threaded screw 30 within its slot 26 so that the legs 24A, 24B are able to slide inwardly against the multi-chambered well 16 and away from the well 16 in order that the clamp 22 be engaged or disengaged from the assembled unit.

In FIG. 2B the clamp 22 is comprised of first and second legs 24A and 24B that overlap one another and are slideable along the overlapping surfaces of the respective legs 24A, 24B. The leg 24A of the clamp 22 extends beyond the side of the assembled unit away from the grasping arm 22A and has a second downwardly extending arm 34A through which a threaded screw 30 is engaged and extends toward the assembled unit. The threaded screw 30 forms a part of the adjusting and tightening means 28 as it cooperates with a friction plate 34B attached to the bottom of the screw 30 that contacts the leg 24B of the clamp 22 to achieve the appropriate gripping force to retain the clamp 22 in place around the assembled unit. In this manner the leg 24A of the clamp 22 extends around and grips the assemble unit by its grasping arm 22A and provides the adjusting and tightening means 28 a mounted position opposing the opposite side of the assembled unit. The leg 24B of the clamp 22 is slid between the assembled unit and the second arm 34A of the leg 24A such that its extends from a point along the top plate 12 of the assembled unit to the end of grasping arm 22B that extends partially along the bottom plate 20 of the assembled unit and lies between the extended arm 34A and the side of the assembled unit. In this fashion the adjusting and tightening means can be manipulated inward and outward along the threads of screw 30 by the knurled head 36 to apply sufficient force against the leg 22B of the clamp 22 by the friction plate 34B to assert the appropriate clamping action and retain the assembled unit together. In reverse fashion the adjusting and tightening means 28 can be loosened and withdrawn from against the leg 24B of clamp 22 in order to disassemble the several parts of the unit. Utilizing the alternately constructed clamps 22 of FIGS. 2A and 2B permits the use of differently sized multi-chambered wells 16 having a variety of differing outer dimensions rather than a fixed, one-size clamp 22 of the first preferred embodiment.

Figure 3:
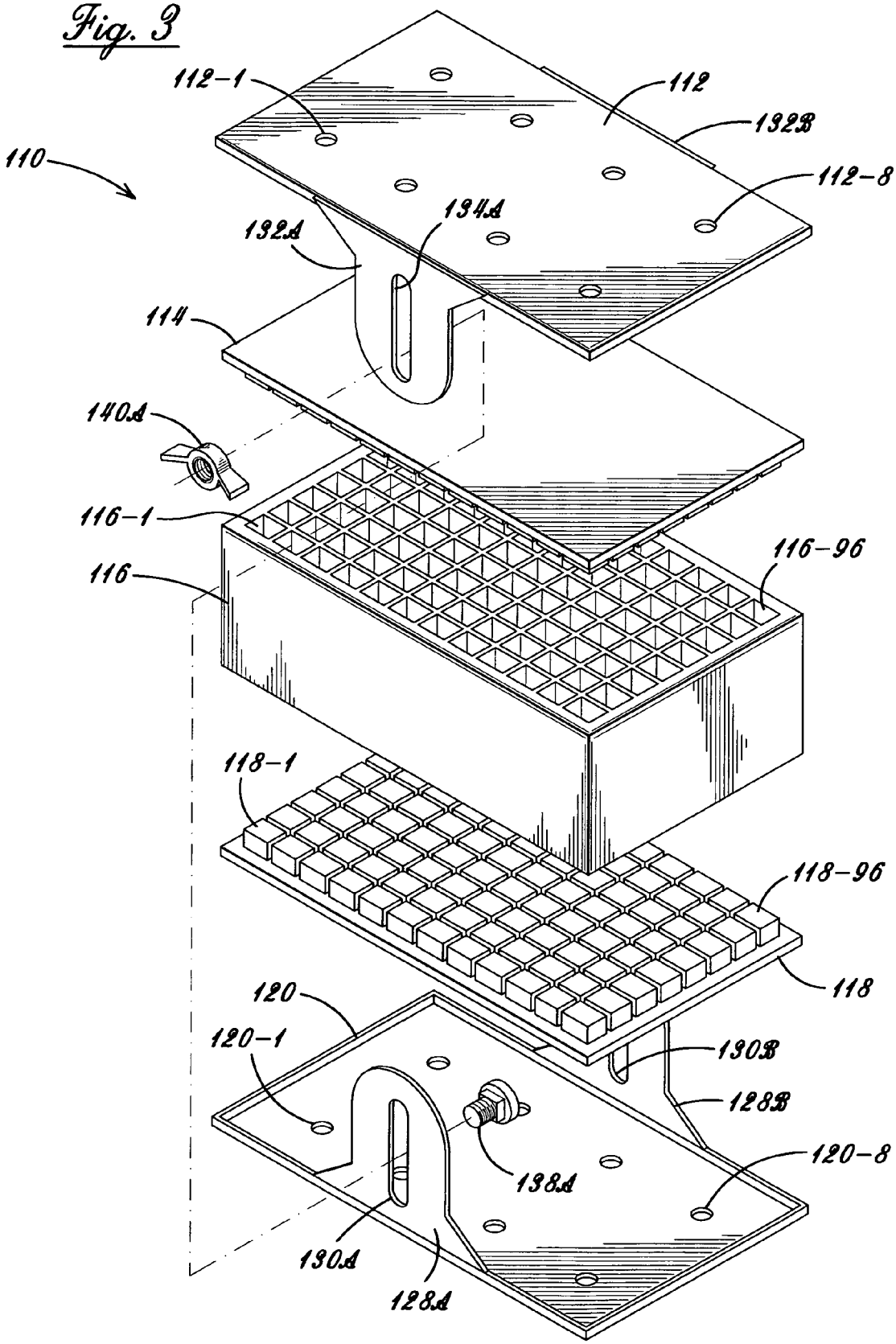
FIG. 3 is an exploded perspective view of a second preferred embodiment, providing top and bottom plates secured together about a container or well and top and bottom sealing mats with a side bracket clamping system.

FIG. 3 shows a second preferred embodiment of the universal clamping apparatus 110 comprising a bottom clamping plate 120, with or without a plurality of small drainage holes, 126-1 through 126-8, the plate also sized to accommodate the most commercially available multi-well array sizes, such as 96 wells/arrays, in a 12×8 array. The bottom plate 120 has a pair of cooperating brackets 128A and 128B extending perpendicularly upward from and on opposite sides of the rectangular plate, each having a channel or slot 130A, 130B to receive a plate position securing means 136. The brackets 128A, 128B are secured to identically sized brackets 132A, 132B extending perpendicularly downward from and on opposite sides of the top plate 112 at the desired spatial relationship depending upon the dimensions of the well through cooperating channels or slots 134A, 134B in the brackets 132A, 132B. Each bracket 128A, 128B and 132A, 132B is retained in the desired positioning clamping the top and bottom sealing mats 114, 118 in sealing engagement with the multi-well chamber 116 using the plate position securing means 136.

Figure 4:
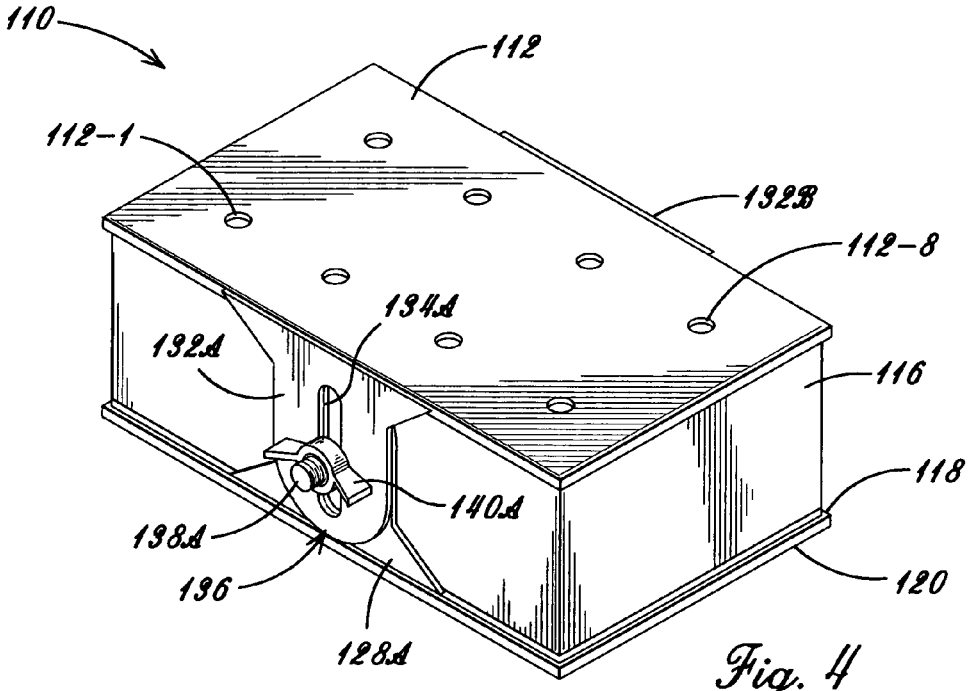
FIG. 4 is a perspective view of the second preferred embodiment in a secure and locked position, providing top and bottom plates with drainage holes with the side bracket clamping system engaged to hold the sealing mats securely in position about the container or well.

In FIGS. 3 and 4 the plate position securing means 136 is shown as comprising a hip-squared carriage bolt with a flat head 138A, 138B that will not turn once engaged in the channels 128A, 128B and 130A, 130B, hand-tightened and secured with wing nuts 140A, 140B. The securing means 136 could also be T-squared nut positioned to slide inside the channels 130A, 130B, 134A, 134B and cooperate with a threaded screw fixedly mounted within a knurled knob used to tighten and loosen the securing means 136. Other securing means having equivalent structures for mechanically retaining the respective top and bottom plates 112, 120 in the desired spatial relationship about the multi-well plate 116 could also be utilized.

The brackets 128A, 128B and 132A, 132B and the channels 130A, 130B and 134A, 134B can be of varying lengths, so as to allow for securely clamping more than one storage container at a time, or containers or wells of varying heights. The brackets 128A, 128B and 132A, 132B attached to each of the top and bottom clamp plates 112, 120 respectively can be positioned so that the paired brackets 128 and 132 can both be outside of the other brackets, or the paired brackets can be oriented to interleave one another. The brackets 128A, 128B and 132A, 132B and top and bottom clamp plates 112, 120 are made of a rigid material, preferably with low thermal expansion and little potential for contaminating the contents of the containment wells 116-1 through 116-96. The top and bottom clamp plates 112, 120, and brackets 128A, 128B and 132A, 132B may be machined from aluminum or similar alloy, or stainless steel, or alternatively, it is also envisioned that they could also be molded from an engineered plastic with relatively low thermal expansion, such as polycarbonate.

To assemble the clamping system, the identically sized bottom sealing mat 118, with a plurality of small raised plugs 118-1 through 118-96 facing upwards, is placed on top of the bottom clamp plate 120. The identically sized multi-well chamber 116, with containment wells or chambers 116-1 through 116-96, is placed on the bottom sealing mat, so as to engage the plugs 118-1 through 118-96 in the bottom of the containment wells. The multi-well containment chambers 116-1 through 116-96 may then be filled with chemicals, reactants, diluents, or compounds, and the like, in order to carry out a reaction or in preparation for storage, or other desired activity. The top sealing mat 114, with small raised plugs 114-1 through 114-96 facing downwards, is placed on top so as to engage each plug securely with each cooperating opening of corresponding containment chamber 116-1 through 116-96. Finally, the identically sized top clamp plate 112, with or with out drainage holes 124-1 through 124-8, is placed on top of the top sealing mat 114, so that the cooperating brackets 132A, 132B and respective slots 134A, 134B are matched with bottom plate brackets 128A, 128B and slots 130A, 130B.

At this point the side brackets 128A, 132A and 128B, 132B are ready to be secured using the clamp securing means 136 comprised of hip-squared carriage bolt 138A, 138B and wing nuts 140A, 140B, placed through slots 130A, 134A and 130B, 134B, respectively. The bolts 138 are secured by tightening the wing nuts 140 at the desired distance along the length of the corresponding channels 130A, 134A and 130B, 134B, depending upon the height of the multi-well chamber(s) 116. The secure clamping apparatus 110, engaged about the multi-well chamber 116 and sealing mats 114, 118, is now ready for storage or other activity as needed.

To disassemble the unit, the wing nuts 140A, 140B are loosened by hand and removed so that the bolt 138A, 138B can be removed from the slots 130A, 134A and 130B, 134B. The top clamping plate 112 is then removed to reveal the top sealing mat cover 114. The top sealing mat cover 114 is then removed to reveal the multi-well compartment chambers 116-1 through 116-96 and the chemicals or compounds that had been placed inside the chambers. The chemicals or compounds are removed by any typical means such as pipette, syringe, or needle, and then the multi-well chamber 116 can be removed from the bottom sealing mat 118. The bottom sealing mat 118 can then be removed from the bottom clamp plate 120, and all the pieces can be cleaned or prepared for use again as needed.

Alternatively, the bracket and plate system can be preassembled and extended to its maximum spatial relationship between the plates and the multi-well plate 116 slid into the opening between the plates 112, 120. With the multi-well plate 116 in position, the plates 112, 120 can be adjusted in an inwardly direction about the multi-well plate 116 to provide a clamping force directly upon the one or more sealing mats 114, 118 and retain the mats in position and sealing engagement with the well 116. The securing means 136 can then be tightened to retain the combination in the desired clamping arrangement until disassembly is required. When the well 116 is to be unclamped, the reverse procedure is utilized, loosening of the securing means 136 and the extension of the top and bottom plates 112, 120 to the maximum spatial relationship, or the necessary spatial relationship, to remove the well 116 and sealing mats 114, 118 from within the clamp.

FIG. 4 shows the second preferred embodiment of the universal secure clamping apparatus 110 in it's final and secure position comprising top clamp plate 112 with drainage holes 124-1 through 124-8, top sealing mat 114, multi-well chamber 116, bottom sealing mat 118, and bottom clamp plate 120. Securing the top and bottom clamp plates 112 and 120 are cooperating brackets 128A and 132A, with matching slots or channels 130A and 134A, secured by the securing means 136 comprising hip-squared carriage bolt 138A and wing nut 140A. The opposite side of the universal clamping means 110, the B side, is not shown in FIG. 4, but each of the elements identically interconnects in the same way. The secure clamping apparatus 110, engaged about the multi-well chamber 116 and sealing mats 114, 118, is now ready for storage or other such activity as needed.

As in the case of the former embodiment, this embodiment may also be modified to exclude the bottom clamping plate 120 and the bottom flexible sealing mat 118 in the event that the multi-well plate 116 has its own integral sealed bottom. As such, the clamping plates 112, 120 will be oriented to fit over and around the multi-well plate 116 and the top sealing mat 114 and engage the entire assembly within the clamping plates 112, 120.

Figure 5:
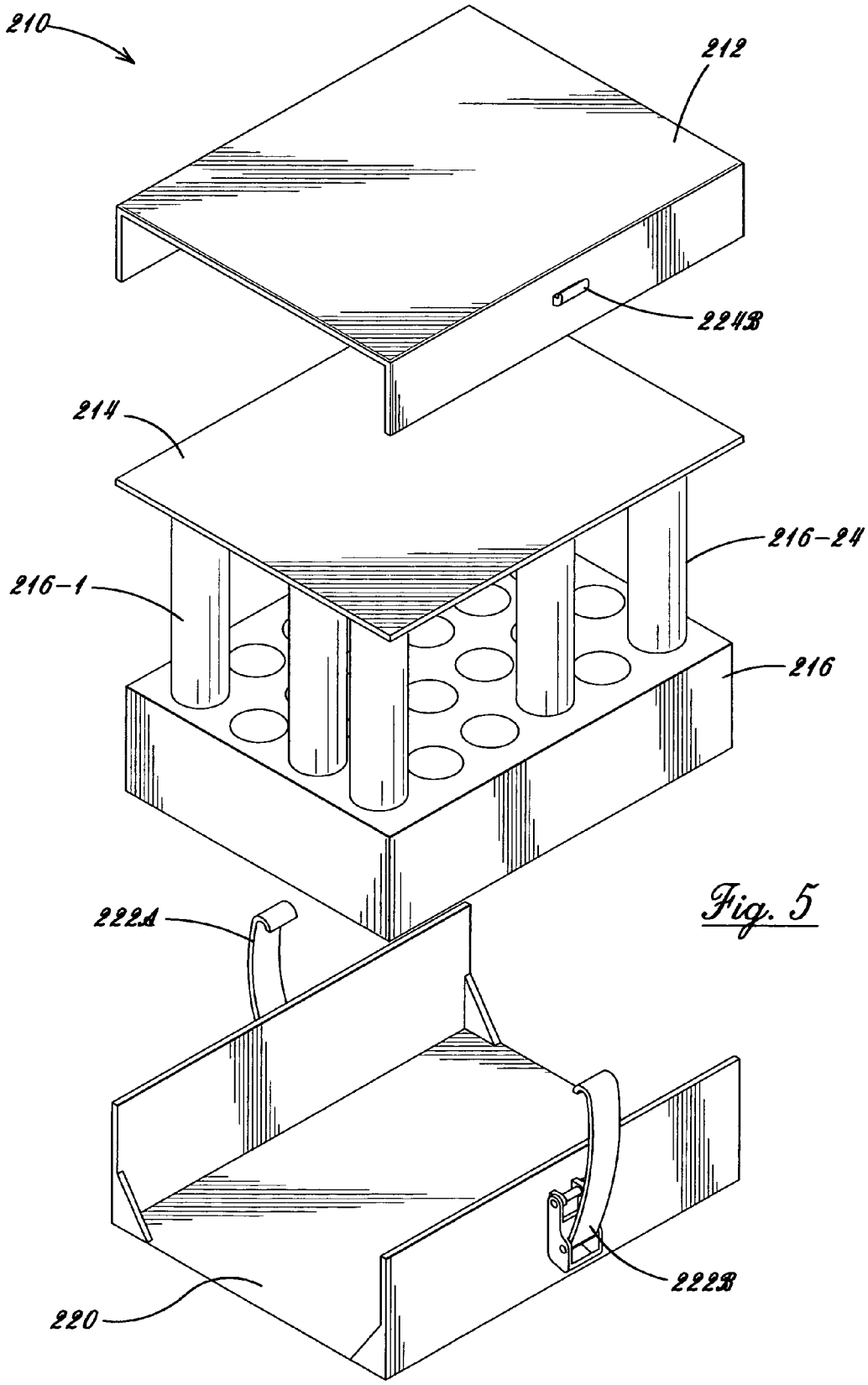
FIG. 5 is an exploded perspective view of a third preferred embodiment of the invention, showing base and top plates and a paired set of articulating clamping arms that engage cooperating opposing latches for securing the plates together retaining the storage container or well, a plurality of storage articles, and the flexible sealing mat cover therebetween.
Figure 6:
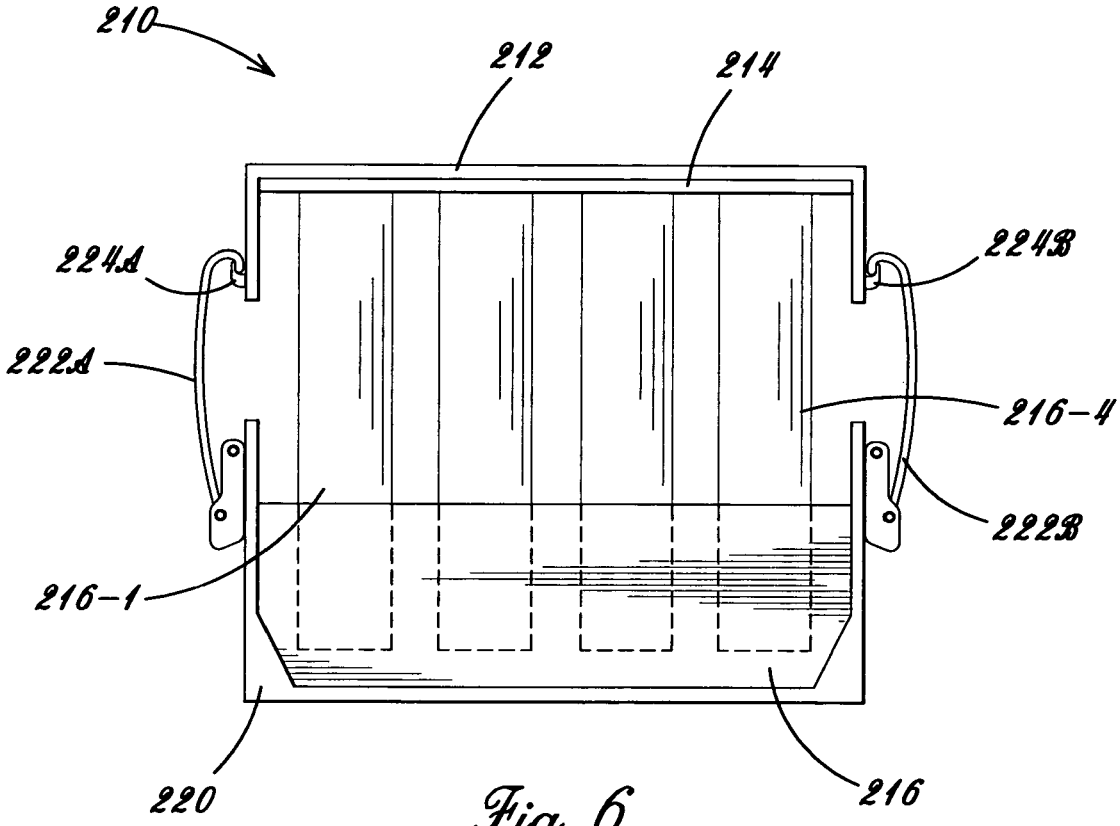
FIG. 6 is a front view of the third preferred embodiment of the invention as shown in FIG. 5.

A third preferred embodiment of the clamping system of the present invention is shown in FIGS. 5 and 6. In this case the article that is to be retained in a sealed condition is a carrier 216 housing a number of cylindrical tubes or vials 216-1 to 216-24 that are shown capped. A sealing mat 214 may be placed over the unsealed tubes or vials 216-1 to 216-24, or over the capped tubes or vials. The mat 214 provides a cushioning effect against the tubes or vials 216-1 to 216-24 as these articles may be made from glass and the amt will tend prevent shattering of the tube or vial by the pressure of the clamping system 210. The carrier 216 is positioned within a bottom plate 220 having opposing upstanding sides. Additionally other positioning structures could be used but are not absolutely necessary. Midway along each upstanding side are paired articulating clamping arms 222A, 222B, each of them are fixedly attached to the sidewalls. The clamping arms 222A, 222B are eccentrically cammed so as to latch in the extended position and release in the opposite position. The top plate 212 also has two opposing sidewalls that extend over the sides of the mat 214 and the carrier 216, each side having a ledge 224A, 224B extending outward from the sidewalls and positioned to cooperate with the grasping ends of the clamping arms 222A, 222B of the clamping system. When engaged by positioning the grasping ends of the clamping arms 222A, 222B over the ledges 224 and rotating the cams away from the ledges 224A, 224B the assembled unit is retained within the clamping system so that it may be stored, stacked, etc. The reversal of the process of rotating the cams toward the ledges releases the ledges 224A, 224B from the grasping ends of the clamping arms 222A, 222B and permits the clamping system to be disengaged from the assembled unit. Once the clamping system is disengaged, the assembled unit may be disassembled, the carrier 216 removed from the clamping system top and bottom plates 212, 220, and the user regains access to the tubes or vials in the carrier 216. Although the drawing shows only a vial array, this embodiment of the universal clamping system is intended to be utilized with a storage block as well.

In summary, the clamping system of the present invention is designed to accommodate both industry standard dimensioned vial arrays, wells and containment blocks and to be adjustable to be able to retain assembled elements together as a unit even though different assembled units may have varying dimensions. Further, the clamping system of the present invention is designed to be adjustable to accommodate assembled units having different dimensions without the need to locate and utilize a clamping system specifically designed for the dimensions of the assembled unit. This includes the adjustability of the clamping system to accommodate changes in both the vertical or height dimension, as well as the length or horizontal dimension of the assembled units. In doing so the clamping system of the present invention exhibits an adjusting means, that is also utilized as a position retaining means, to accommodate the varying height and length dimensions of different assembled units.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

The invention claimed is:

1. A universal secure storage apparatus including a C-type clamping means that retain said storage apparatus in an assembled mode for stacking and storage single and multi-well storage blocks having differing dimensions comprising at least one cover plate and at least one sealing mat for covering and securing the one or more openings in the storage block, a clamping means adapted to mate with and securely retain in juxtaposed relationship the storage block, sealing mat and at least one cover plate as an assembled unit to prevent spoilage to the contents, said clamping means having a pair of bracket legs and an adjustment and tightening means comprising an elongated slot in each of the legs with said slot allowing the clamping means to expand and contract inwardly to grasp the unit and outwardly away from the unit accommodating units having a variety of different horizontal or vertical dimensions.

2. The universal secure clamping system of claim 1 wherein the clamping means is comprised of a C-shaped elongated semi-rigid strip extending along and over the top of the assembled unit said pair of bracket legs extending downward and around the bottom of the assembled unit to securely retain the storage block, sealing mat and at least one cover plate in the desired juxtaposed relationship to prevent spoilage to the contents and to accommodate different sized units as well as containing stacked units together as a whole unit.

3. The universal secure clamping system of claim 1 wherein the clamping means is comprised of a C-shaped elongated semi-rigid strip having overlapping clamp arms that are expandable and contractible inwardly and outwardly away from the unit along and over the top of the assembled unit, each of said bracket legs having a distal gripping end that extends downward and around the bottom of the assembled unit to securely retain the storage block, sealing mat and at least one cover plate in the desired juxtaposed relationship, and said adjustment and tightening means comprised of an elongated slot in each of the overlapping bracket legs through which slot a threaded screw extends outward to mate with and engage a flanged nut by which the overlapping bracket legs are adjusted inward or outward to accommodate assembled units having a variety of different horizontal and vertical dimensions.

4. The universal secure storage apparatus of claim 1 wherein the C-type clamping means is comprised of an elongated semi-rigid strip having overlapping clamp arms that are adjustably moveable inward and outward along and over the top of the assembled unit, each of said clamp arms having a distal gripping end that extends downward and around the bottom of the assembled unit to securely retain the storage block, sealing mat and at least one cover plate in the desired juxtaposed relationship, and an adjustment and tightening means comprised of a downwardly extending arm from the proximal end of the clamp arm that extends along and over the top of the assembled unit, an adjustment screw threaded through the downwardly extending arm in an inward direction with a friction plate at the distal end thereof for contacting the other clamp arm that extends along the side of the assembled unit to assert a gripping force against the other clamp arm to securely retain the assembled unit together, said adjustment screw being manipulated inward or outward to accommodate assembled units having a variety of different horizontal and vertical dimensions.

5. The universal secure storage apparatus of claim 1 wherein at least one sealing mat is further comprised of a plurality of drainage or injection ports aligned with and corresponding to the number of wells in the storage block for permitting reactions to occur while the clamping means is engaged around the assembled unit.

6. The universal secure storage apparatus of claim 1 wherein the at least one cover plate is further comprised of a plurality of apertures aligned with and corresponding to the number of wells in the storage block for permitting reactions to occur while the clamping apparatus is engaged around the assembled unit.

7. A universal secure storage apparatus including a C-type clamping means that retain said storage apparatus in an assembled mode for stacking and storage single and multi-well storage blocks and vial arrays having differing dimensions comprising at least one sealing mat for covering and securing the one or more openings in the storage block and the plurality of vials in the array, said C-type clamping means being adjustable and adapted to mate with and securely retain in juxtaposed relationship the storage block or vial array, sealing mat and at least one cover plate as an assembled unit to prevent spoilage to the contents, said clamping means is comprised of top and bottom clamp plates having opposing opposite side bracket clamping arms that are expandable and contractible upward and downward to accommodate a variety of horizontal or vertical dimensions along the sides of the assembled unit, each of said bracket clamping arms extending toward and partially overlapping its opposing bracket clamping arm, and an adjustment and tightening means for releasably securing the assembled unit comprising an elongated slot in each of the overlapping bracket clamping arms through which slots a threaded screw extends outward to mate with and engage a flanged nut such that the overlapping clamp arms are adjustable upward or downward to accommodate a variety of assembled units and to securely retain the assembled unit in the desired juxtaposed relationship.

8. The universal secure storage apparatus of claim 7 wherein the at least one sealing mat is further comprised of a plurality of drainage or injection ports aligned with and corresponding to the number of wells in the storage block for permitting reactions to occur while the C-type clamping means is engaged around the assembled unit.

9. The universal secure storage apparatus of claim 7 wherein the top and bottom clamp plates are further comprised of a plurality of apertures aligned with and corresponding to the number of wells in the storage block for permitting reactions to occur while the C-type clamping means is engaged around the assembled unit.

10. The universal secure storage apparatus of claim 7 wherein the C-type clamping means is comprised of top and bottom clamp plateseach having opposing partial sidewalls extending along the sides of the assembled unit, a set of eccentrically cammed bracket clamping arms mounted to each of the bottom plate sidewalls and extending toward and engageable with an opposing grasping ledge mounted to each of the top plate sidewalls such that when engaged the bracket clamping arms securely retain the assembled unit in the desired juxtaposed relationship and accommodate assembled units having a variety of different horizontal and vertical dimensions.

11. The universal secure storage apparatus of claim 10 wherein the at least one sealing mat is further comprised of a plurality of drainage or injection ports aligned with and corresponding to the number of wells in the storage block for permitting reactions to occur while the C-type clamping means is engaged around the assembled unit.

12. The universal secure storage apparatus of claim 10 wherein the top and bottom clamp plates are further comprised of a plurality of apertures aligned with and corresponding to the number of wells in the storage block for permitting reactions to occur while the C-type clamping means is engaged around the assembled unit.

* * * * *